US008025452B2

(12) United States Patent
Hong

(10) Patent No.: US 8,025,452 B2
(45) Date of Patent: Sep. 27, 2011

(54) PRINT MEDIUM SUPPLYING DEVICE AND IMAGE FORMING APPARATUS HAVING THE SAME

(75) Inventor: Jong-cheon Hong, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 847 days.

(21) Appl. No.: 11/972,092

(22) Filed: Jan. 10, 2008

(65) Prior Publication Data

US 2008/0286027 A1 Nov. 20, 2008

(30) Foreign Application Priority Data

May 16, 2007 (KR) ..... 10-2007-0047742

(51) Int. Cl.
*B41J 11/58* (2006.01)

(52) U.S. Cl. ..... 400/624; 400/629

(58) Field of Classification Search ..... 400/624, 400/629
See application file for complete search history.

(56) References Cited

U.S. PATENT DOCUMENTS 5,215,299 A * 6/1993 Luft ..... 271/160
5,294,105 A * 3/1994 Kaburagi et al. ..... 271/157
5,335,901 A * 8/1994 Nonomura et al. ..... 271/117
5,794,928 A * 8/1998 Araseki et al. ..... 271/9.08

* cited by examiner

*Primary Examiner* — Anthony H Nguyen
(74) *Attorney, Agent, or Firm* — Stanzione & Kim, LLP

(57) ABSTRACT

A print medium supplying device, includes a frame, a mounting plate to mount a print medium, an elevating unit to move upward and downward the mounting plate within the frame, and an elastic unit which comprises an installation unit disposed to one of the frame and the mounting plate, a coupling unit coupled to an other of the frame and the mounting plate, and a spring unit provided between the installation unit and the coupling unit to elastically weaken a falling motion of the mounting plate.

15 Claims, 8 Drawing Sheets

PRINT MEDIUM SUPPLYING DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 10-2007-0047742, filed on May 16, 2007 in the Korean Intellectual Property Office, the disclosure of which is incorporated herein in its entirety by reference.

BACKGROUND OF THE INVENTION

1. Field of the Invention

The present general inventive concept relates to a print medium supplying device and an image forming apparatus having the same, and more particularly, to a print medium supplying device and an image forming apparatus to reduce a falling impact of a mounting plate on which a print medium is mounted when the print medium supplying device is in a mounting position and is separated from the image forming apparatus.

2. Description of the Related Art

In general, a print medium supplying device is employed in an image forming apparatus such as a printer, a copy machine, a facsimile, etc., and picks up a print medium mounted inside thereof, one by one, to be supplied to the image forming apparatus. The print medium supplying device may be classified according to a print medium mounting capacity such as a print medium supplying device having the print medium mounting capacity within several hundred sheets of print media, and a print medium supplying device of high capacity having the print medium mounting capacity of approximate 2,000 sheets of print media.

Referring to FIG. 1, a related art print medium supplying device includes a frame 11 accommodating a print medium 1 therein, and a mounting plate 13 disposed within the frame 11 to move upward and downward. The print medium 1 is mounted on the mounting plate 13. The mounting plate 13 is driven by a driving force supplied from a driving source (not illustrated) provided in an image forming apparatus, and an elevating unit 15. The elevating unit 15 includes first and second pulleys 16 and 17 distantly disposed in a vertical direction of the frame 11, and a timing belt 19 to wind around the first and second pulleys 16 and 17. The first pulley 16 receives the driving force supplied from the driving source through a shaft 16a and a coupler (not illustrated) provided on a same axis to rotate the timing belt 19. The mounting plate 13 is disposed proximate to the timing belt 19 to move upward and downward depending on a driving direction of the timing belt 19. Accordingly, the print medium 1 can be smoothly supplied by adjusting a height of the mounting plate 13 according to a number of the print media 1 mounted on the mounting plate 13.

If the print medium supplying device is detached from the image forming apparatus to additionally mount the print medium 1, the coupler is separated so that the driving force transmitted from the driving source to the shaft 16a can be intercepted. Accordingly, the first and second pulleys 16 and 17 rotate free, and the mounting plate 13 falls free by its own weight. Accordingly, the print medium supplying device may be damaged, and noises may be generated.

The related art print medium supplying device further includes a gear 21 provided coaxially with the first pulley 16, and a gear oil damper 23 engaged to the gear 21 to prevent the mounting plate 13 from falling free. Accordingly, when the coupler is separated, the mounting plate 13 falls down while the first pulley 16 rotates in a low speed, thereby relieving the problem related to the free falling of the mounting plate 13.

However, in the related art print medium supplying device as illustrated in FIG. 1, since the weight on the mounting plate 13 and a height of a central point of the weight thereon vary according to a number of the print media 1 mounted on the mounting plate 13, it is difficult to design the gear oil damper 23 to be appropriate for such various conditions.

Accordingly, the gear oil damper 23 is designed based on a condition that there is no print medium 1 mounted on the mounting plate 13.

However, if the gear oil damper 23 is designed under this condition, a buffering action corresponding to the gear oil damper 23 is weakened. Accordingly, if the print medium supplying device is detached from the image forming apparatus while a considerable number of print media 1 are mounted on the mounting plate 13, the print medium supplying device may be damaged, and noises may be generated.

SUMMARY OF THE INVENTION

The present general inventive concept to provide a print medium supplying device and an image forming apparatus having the same to reduce a falling speed of a mounting plate irrespective of a number of mounted print media to prevent the print medium supplying device from being damaged and to reduce noises when the print medium supplying device is in a mounting position and is separated from the image forming apparatus.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a print medium supplying device, including a frame, a mounting plate to mount a print medium, an elevating unit to move upward and downward the mounting plate within the frame, and an elastic unit which includes an installation unit disposed to one of the frame and the mounting plate, a coupling unit coupled to an other of the frame and the mounting plate, and a spring unit disposed between the installation unit and the coupling unit to elastically weaken a falling motion of the mounting plate.

The elastic unit may further include an elastic plate having a tape shape, and spirally winds around the installation unit.

The coupling unit may be disposed in an end portion of the spring unit to be engaged to the mounting plate, if the mounting plate falls below a predetermined height.

The elastic unit may be provided in plurality, and each elastic unit may be provided at a plurality of positions along a perimeter of the mounting plate.

The elevating unit may includes a driving pulley disposed in the frame to be rotated by an applied driving force, a driven pulley disposed in the frame to be distanced from the driving pulley in a vertical direction of the frame, and a belt to rotatably wind around the driving pulley and the driven pulley, and is coupled with the mounting plate.

The foregoing and/or other aspects and utilities of the present general inventive concept can also be achieved by providing a print medium supplying device, including a frame, a mounting plate disposed in the frame to move upward and downward, and to mount a print medium, an elevating unit disposed in the frame to adjust a height of the mounting plate based on a number of the print media mounted on the mounting plate, and an elastic unit to elastically support the mounting plate to reduce a falling impact when the mounting plate lifted to a predetermined height falls down according to a release of a driving force to drive the elevating unit.

The elastic unit may include an installation unit disposed in the frame, a coupling unit to selectively couple the mounting plate, and a spring unit provided between the installation unit and the coupling unit to elastically weaken a falling motion of the mounting plate.

The elastic unit may include an elastic plate having a tape shape, and spirally winds around the installation unit.

The positions of the frame may respectively correspond to a minimum height and a maximum height of the mounting plate disposed to move upward and downward with respect to the frame may be respectively referred to a first position and a second position, the installation unit may be disposed between the first position and the second position, may elastically support the mounting plate when the mounting plate is positioned between the first position and the installation unit, and may be separated from the mounting plate when the mounting plate is positioned between the installation unit and the second position.

The elastic unit may be provided in plurality, and each elastic unit may be provided at a plurality of positions along a perimeter of the mounting plate.

The elevating unit may include a driving pulley disposed in the frame to be rotated by an applied driving force, a driven pulley disposed in the frame to be distanced from the driving pulley in a vertical direction of the frame, and a belt to rotatably wind around the driving pulley and the driven pulley, and may be coupled with the mounting plate.

The foregoing and/or other aspects and utilities of the present general inventive concept can also be achieved by providing an image forming apparatus, including a print medium supplying device comprising a frame, a mounting plate to mount a print medium, an elevating unit to move upward and downward the mounting plate within the frame, and an elastic unit which comprises an installation unit disposed to one of the frame and the mounting plate, a coupling unit coupled to an other of the frame and the mounting plate, and a spring unit provided between the installation unit and the coupling unit to elastically weaken a falling motion of the mounting plate, and an image forming unit to form an image with respect to the print medium supplied by the print medium supplying device.

The elastic unit may further include an elastic plate having a tape shape, and spirally winds around the installation unit.

The coupling unit may be disposed in an end portion of the spring unit to be engaged to the mounting plate, if the mounting plate falls below a predetermined height.

The elastic unit may be provided in plurality, and each elastic unit may be provided at a plurality of positions along a perimeter of the mounting plate.

The elevating unit may include a driving pulley disposed in the frame to be rotated by an applied driving force, a driven pulley disposed in the frame to be distanced from the driving pulley in a vertical direction of the frame, and a belt to rotatably wind around the driving pulley and the driven pulley, and is coupled with the mounting plate.

The foregoing and/or other aspects and utilities of the present general inventive concept can also be achieved by providing an image forming apparatus, including a print medium supplying device comprising a frame, a mounting plate disposed in the frame to move upward and downward, and to mount a print medium, an elevating unit which is disposed in the frame to adjust a height of the mounting plate based on a number of the print media mounted on the mounting plate, and an elastic unit to elastically support the mounting plate to reduce a falling impact when the mounting plate which is lifted to a predetermined height falls down according to a release of a driving force to drive the elevating unit, and an image forming unit to form an image with respect to the print medium supplied by the print medium supplying device.

The elastic unit may include an installation unit disposed in the frame, a coupling unit to selectively couple the mounting plate, and a spring unit provided between the installation unit and the coupling unit to elastically weaken a falling motion of the mounting plate.

The elastic unit may include an elastic plate having a tape shape, and spirally winds around the installation unit.

The positions of the frame may respectively correspond to a minimum height and a maximum height of the mounting plate disposed to move upward and downward with respect to the frame may be respectively referred to a first position and a second position, the installation unit may be disposed between the first position and the second position, may elastically support the mounting plate when the mounting plate is positioned between the first position and the installation unit, and may be separated from the mounting plate when the mounting plate is positioned between the installation unit and the second position.

The elastic unit may be provided in plurality, and each elastic unit is provided at a plurality of positions along a perimeter of the mounting plate.

The elevating unit may include a driving pulley disposed in the frame to be rotated by an applied driving force, a driven pulley disposed in the frame to be distanced from the driving pulley in a vertical direction of the frame, and a belt to rotatably wind around the driving pulley and the driven pulley, and is coupled with the mounting plate.

The foregoing and/or other aspects and utilities of the general inventive concept may also be achieved by providing a print medium supplying device usable with an image forming apparatus, the print medium supplying device comprising a frame, a mounting plate disposed proximate to the frame to store and to supply a print medium, and one or more elastic units disposed between the frame and the mounting plate to elastically weaken a falling motion of the mounting plate.

The foregoing and/or other aspects and utilities of the general inventive concept may also be achieved by providing an image forming apparatus, comprising a print medium supplying device comprising a frame, a mounting plate disposed proximate to the frame to store and to distribute a print medium, and an elastic unit disposed between the frame and the mounting plate to elastically weaken a falling motion of the mounting plate, and an image forming unit to form an image on the print medium supplied by the print medium supplying device.

The foregoing and/or other aspects and utilities of the general inventive concept may also be achieved by providing a print medium supplying device usable with an image forming apparatus, the print medium supplying device comprising a frame, a mounting plate disposed in the frame to move with respect to the frame to support a print medium, and an elastic unit disposed at a position within a moving distance of the mounting plate not to apply an elastic force to the moving plate and to apply a variable elastic force to the moving plate.

BRIEF DESCRIPTION OF THE DRAWINGS

These and/or other aspects and utilities of the present general inventive concept will become apparent and more readily appreciated from the following description of embodiments, taken in conjunction with the accompanying drawings of which.

DETAILED DESCRIPTION OF THE PREFERRED EMBODIMENTS

Figure 1:
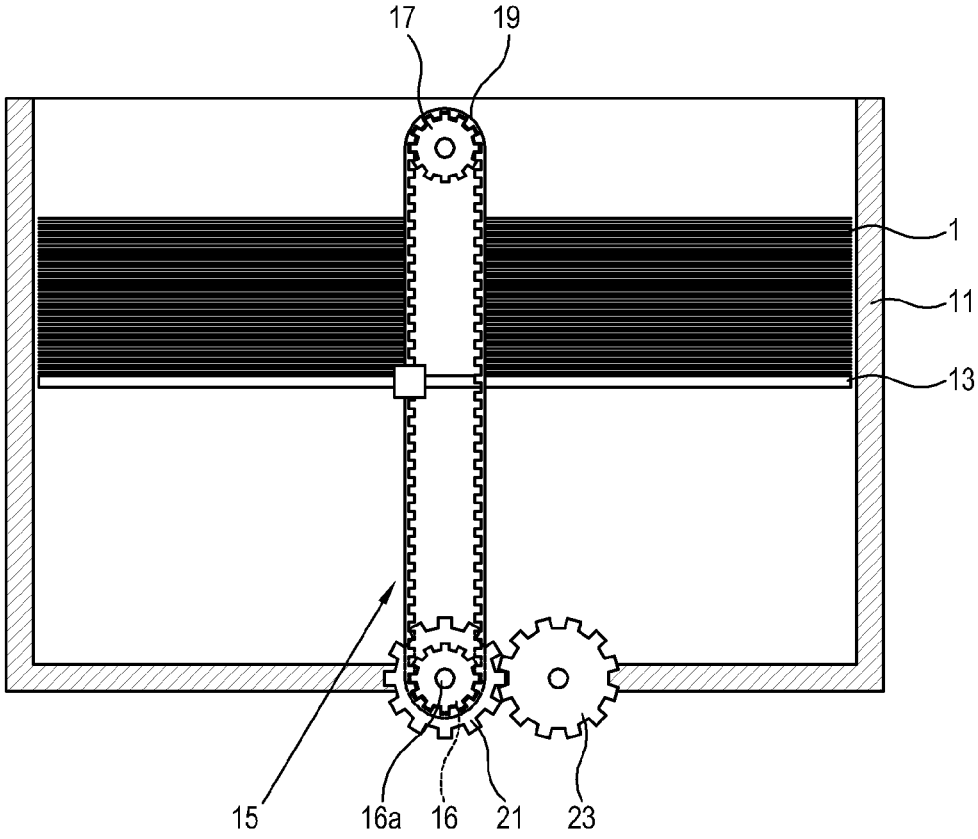
FIG. 1 (RELATED ART)
FIG. 1 is a schematic sectional view illustrating a related art print medium supplying device of high capacity.
Figure 2:
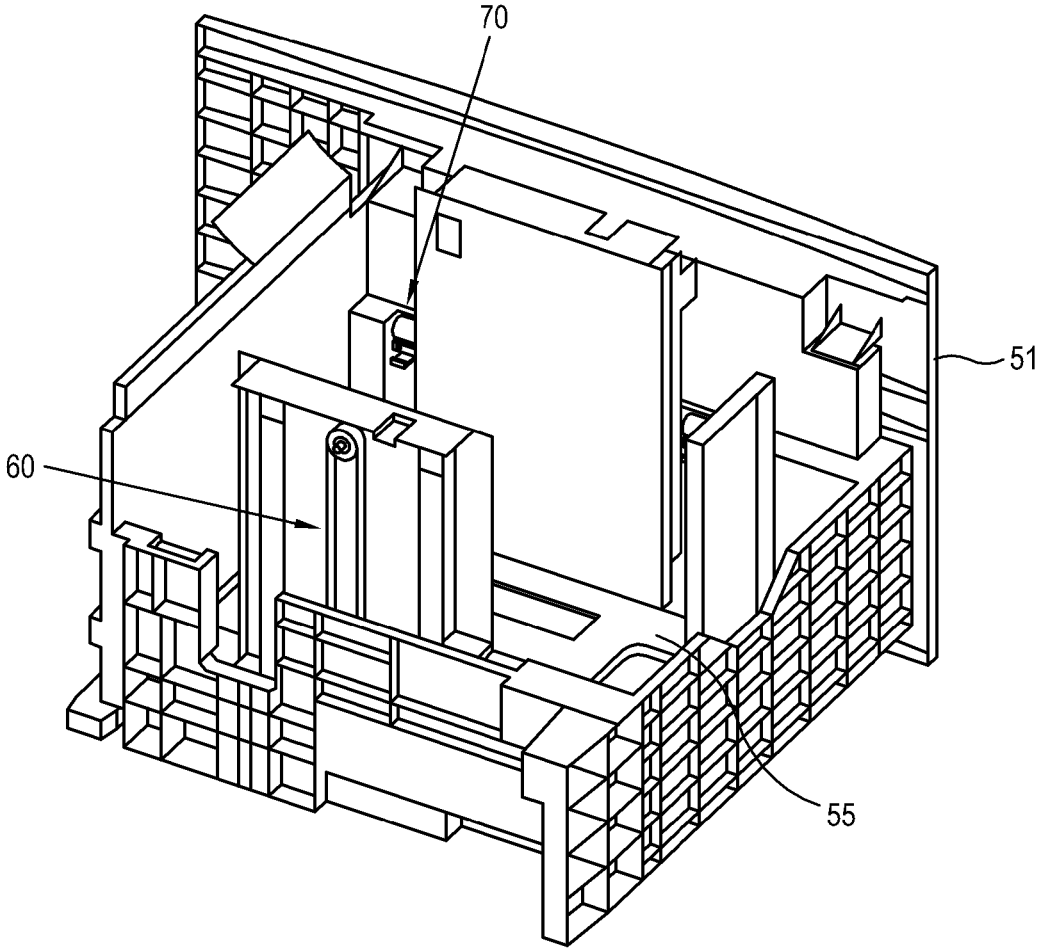
FIG. 2 is a schematic perspective view illustrating a print medium supplying device according to an exemplary embodiment of the present general inventive concept.

Reference will now be made in detail to embodiments of the present general inventive concept, examples of which are illustrated in the accompanying drawings, wherein like reference numerals refer to like elements throughout. The embodiments are described below in order to explain the present general inventive concept by referring to the figures.

As illustrated in FIGS. 2 to 6, a print medium supplying device usable with an image forming apparatus according to an exemplary embodiment of the present general inventive concept includes a frame 51, a mounting plate 55 to mount a print medium, an elevating unit 60 to move upward and downward the mounting plate 55 inside the frame 51 and an elastic unit 70.

The frame 51 is detachably mounted to an image forming apparatus, and accommodates a print medium 50 therein. The mounting plate 55 is disposed in the frame 51, and moves upward and downward by the elevating unit 60. The elevating unit 60 includes a sub frame 61 disposed in the frame 51, a driving pulley 63 and a driven pulley 65 distantly disposed to the sub frame 61, and a belt 67 to wind around the driving pulley 63 and the driven pulley 65. The driving pulley 63 receives a driving force supplied from a driving source 85 through a shaft 81 and a coupler 83 provided on a same axis to enable the belt 67 to rotate. The driven pulley 65 is disposed to the frame 51 to be distanced from the driving pulley 63 in a vertical direction of the frame 51. The belt 67 is provided, for example, as a timing belt, and winds around the driving pulley 63 and the driven pulley 65. The mount plate 55 is coupled to the belt 67 to move upward and downward depending on a rotation of the belt 67. Accordingly, the print medium 50 can be smoothly supplied by adjusting a height of the mounting plate 55 according to a number of the print media 50 mounted on the mounting plate 55. The image forming apparatus may include a pick-up unit 30 as a print medium feeding unit disposed to pick-up and feed the print medium 50 toward an image forming unit (not illustrated) along a feeding and printing path. The pick-up unit 30 may be disposed on a position to pick-up and feed the print medium 50.

Figure 4A:
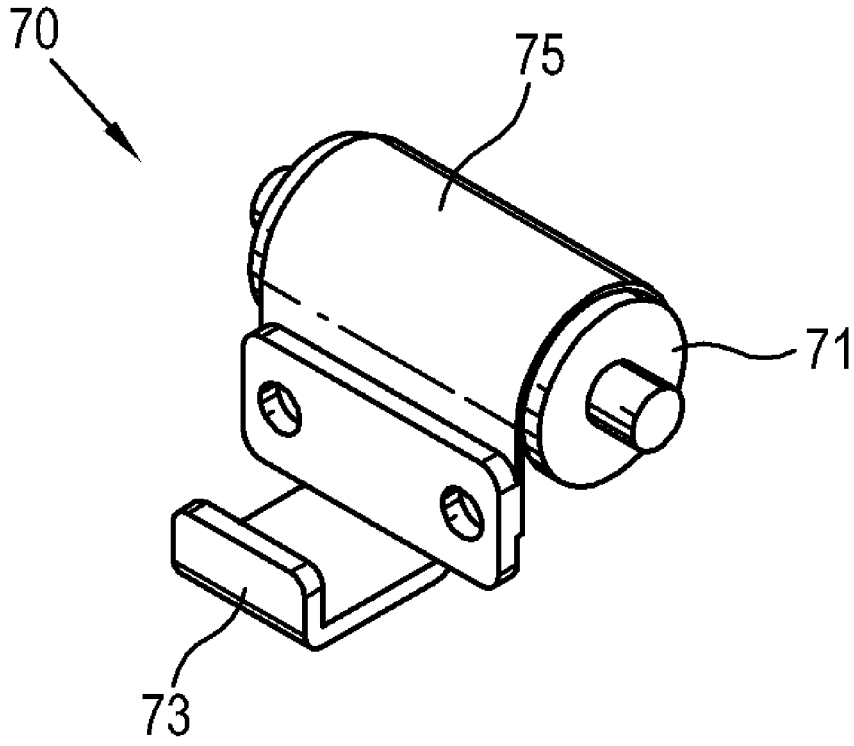
FIGS. 4A and 4B are perspective views illustrating a spring unit of the print medium supplying device according to the exemplary embodiment of the present general inventive concept.
Figure 4B:
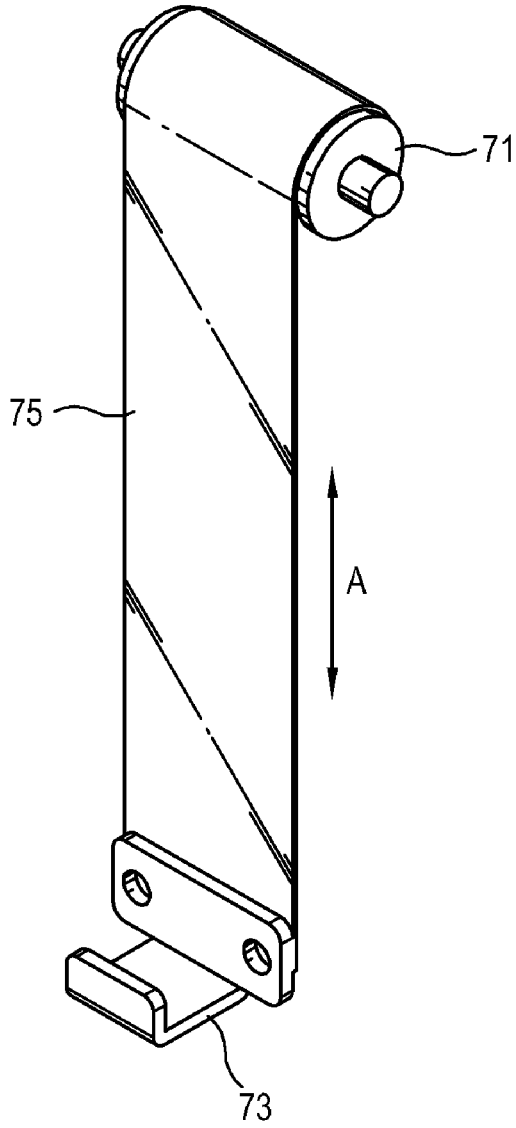

Referring to FIGS. 4A and 4B, when the print medium supplying device, according to the exemplary embodiment of the present general inventive concept, is separated from the image forming apparatus in the mounting position, the elastic unit 70 reduces a falling speed of the mounting plate 55 irrespective of an amount of the mounted print medium 50. For this, the elastic unit 70 is provided in plurality, and may be provided at a plurality of positions along a perimeter of the mount plate 55.

The respective elastic units 70 include an installation unit 71 to couple one of the frame 51 and the mounting plate 55, and a spring unit 75 to elastically reduce the falling speed of a coupling unit 73 and the mounting plate 55.

Figure 3:
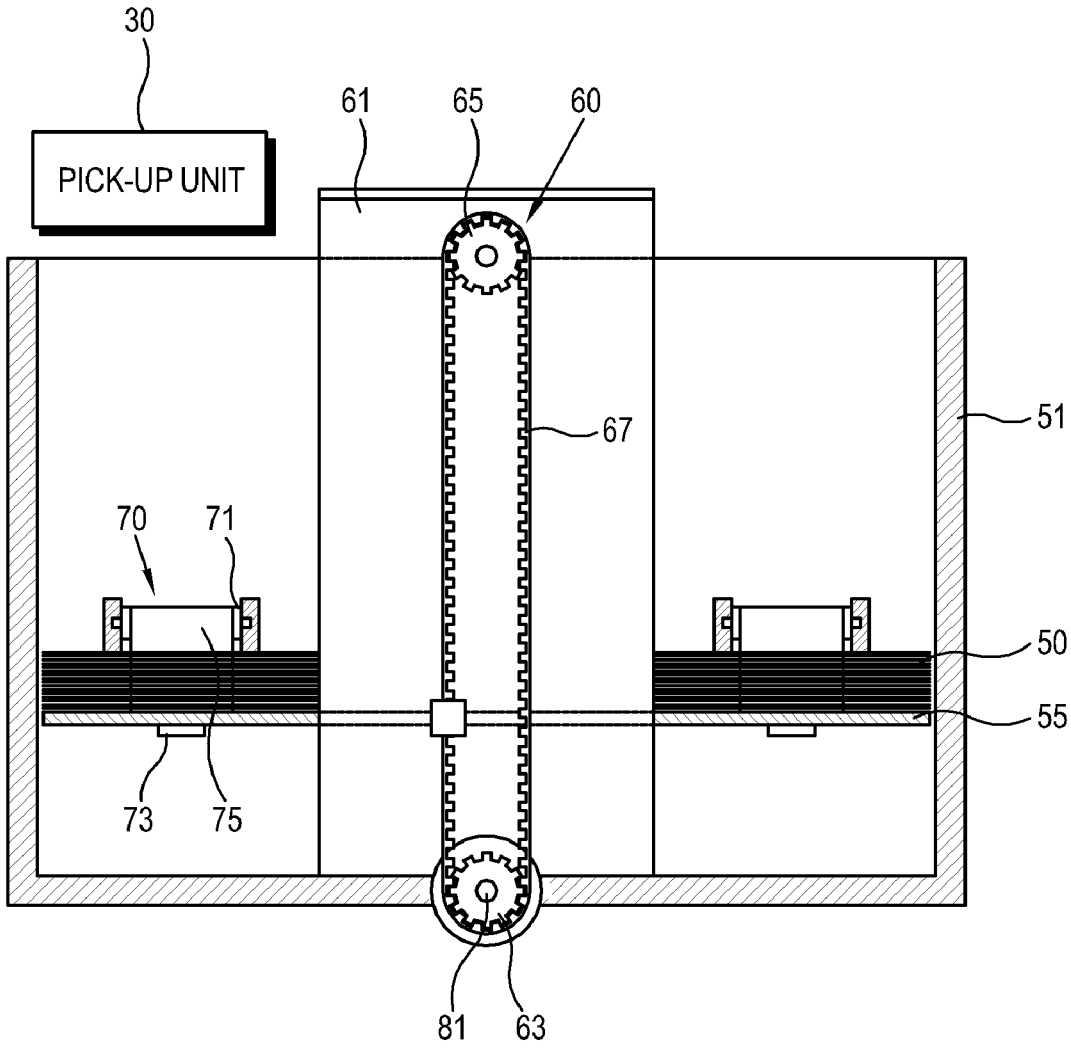
FIG. 3 is a schematic sectional view illustrating the print medium supplying device according to the exemplary embodiment of the present general inventive concept.

The installation unit 71 is employed to securely couple an end portion of the spring unit 75, and may couple the frame 51 as illustrated in FIG. 3. Alternatively, the installation unit 71 may couple the mounting plate 55. As illustrated therein, the installation unit 71 may be provided separately from the spring unit 75. Alternatively, the installation unit 71 may be integrally provided in an end portion of the spring unit 75. The installation unit 71 may be stationary with respect to the frame 51, and the coupling unit 73 may be movable with respect to the installation unit 71 to move together with the mounting plate 55 to apply an elastic force to the mounting plate 55. The elastic force may be variable according to a height of the mounting plate 55 within the frame 51.

The coupling unit 73 is disposed at an end portion of the spring unit 75, and is coupled to the other of the frame 51 and the mounting plate 55. For example, as illustrated in FIG. 3, if the installation unit 71 is coupled to the frame 51, the coupling unit 73 is coupled to the mounting plate 55. Here, since the coupling unit 73 is capable of being selectively coupled with the mounting plate 55, the coupling unit 73 is engaged with the mounting plate 55 when the mounting plate 55 falls below a predetermined height, and is distanced from the mounting plate 55 when the mounting plate 55 is maintained to a position above a predetermined height.

That is, if the positions of the frame 51 corresponding to a minimum height and a maximum height of the mounting plate 55 disposed to move upward and downward with respect to the frame 51 are respectively referred to a first position and a second position, the installation unit 71 is disposed between the first position and the second position. Accordingly, when the mounting plate 55 is positioned between the first position and the installation unit 71, the mounting plate 55 is elastically supported by the installation unit 71, or the coupling unit 73. Also, when the mounting plate 55 is positioned between the installation unit 71 and the second position, the installation unit 71, or the coupling unit 73 is separated from the mounting plate 55.

The spring unit 75 is provided between the installation unit 71 and the coupling unit 73 to elastically weaken the falling motion of the mounting plate 55. For this, the spring unit 75 may include an elastic plate having a tape shape and spirally winding around the installation unit 71.

Since the mounting plate 55 is movable with respect to the pick-up unit 30 such that the print medium 50 can be picked-up by the pick-up unit 30, the elastic unit 70 may not apply the elastic force to the mounting plate 55 when a distance between the pick-up unit 30 and the mounting plate 55 is not greater than a reference distance representing a number of print media 50 mounted on the mounting plate 55, and may apply a variable elastic force to the mounting plate 55 according to the distance to support the mounting plate 55 when the distance is greater than the reference distance.

Hereinafter, an operating state of the print medium supplying device according to the exemplary embodiment of the present general inventive concept will be described by referring to FIGS. 5 and 6.

For example, if the print medium supplying device according to the exemplary embodiment of the present general inventive concept accommodates a maximum 2,000 sheets of print media having a size of A4, a total mass of the print media is approximately 11 to 13 kg, and a mounted height thereof is approximately 220 mm. Here, since an uppermost positioned print medium among the accommodated entire print media 50 is positioned in a supplying position, the mounting plate 55 is positioned near a lower surface of the frame 51. Here, the coupling unit 73 is engaged to the mounting plate 55, and the spring unit 75 is expanded to have a maximum length thereof.

Here, if the elastic unit 70 is provided at four places along the perimeter of the mounting plate 55, and a buffering force of 1 kg gravity is applied to each elastic unit 70, a total force of 4 kg gravity can be reduced. Accordingly, a force of approximately 7 to 9 kg gravity can be applied to the mounting plate 55. This state is maintained irrespectively of whether to supply the driving force to the print medium supplying device.

Figure 5:
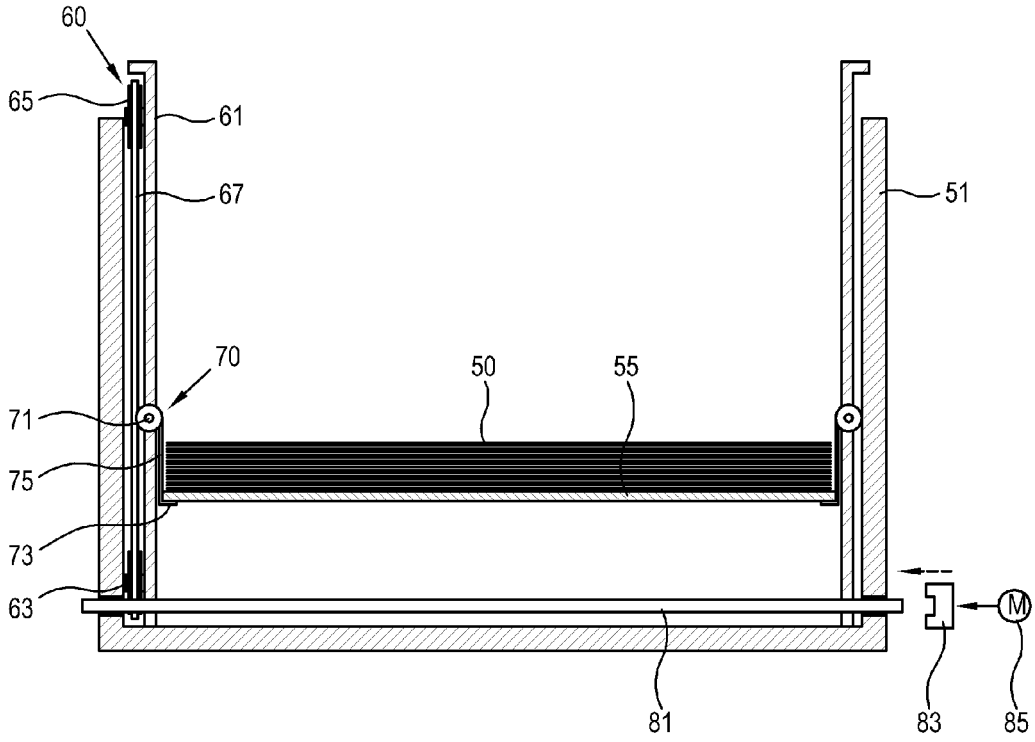
FIGS. 5 and 6 schematically illustrate operating states of the print medium supplying device according to the exemplary embodiment of the present general inventive concept.
Figure 6:
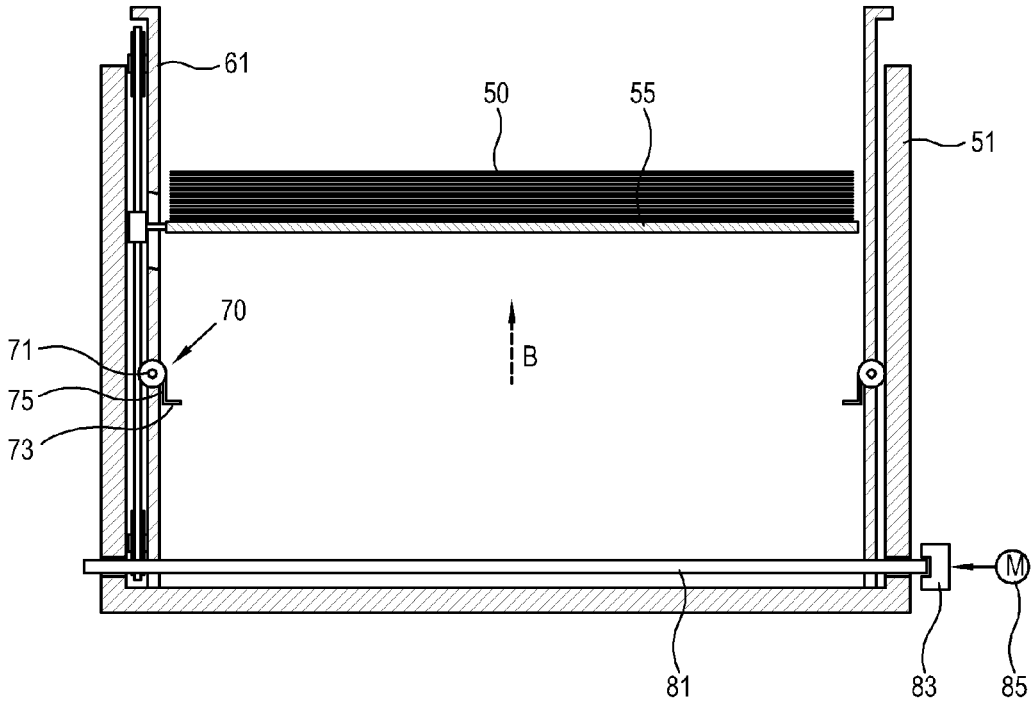

While the driving force is supplied to the print medium supplying device, if the number of the print media 50 mounted on the mounting plate 55 is reduced, the mounting plate 55 moves upward to a position as illustrated in FIG. 5 so that the print medium mounted on an uppermost portion thereof can maintain the supplying position.

For example, if approximately 1,000 sheets of the print media 50 are mounted on the mounting plate 55, the mounting plate 55 moves upward by approximately 100 mm or greater as compared to a mounting of approximately 2,000 sheets of the print media 50. Here, the total mass of the print medium 50 is approximately 6 to 7 kg. If the elastic unit 70 is disposed in a position of approximate 100 mm from a bottom surface, the mounting plate 55 is distanced apart from the coupling unit 73 as illustrated in FIG. 6.

The print medium supplying device is separated from the image forming apparatus, for example, as described below.

If the number of the print media 50 mounted on the mounting plate 55 is less than 1,000 sheets, the force is applied to the elastic unit 70 during feeding of the print medium 50. Thus, if the print medium supplying device is separated from the image forming apparatus, the driving force supplied from the driving source 85 to the shaft 81 and the driving pulley 63 is intercepted in the coupler 83. Accordingly, the mounting plate 55 falls free to reach an installation position of the elastic unit 70. The mounting plate 55 falling free is engaged to the coupling unit 73 in the installation position of the elastic unit 70 so that the elastic unit 70 can accomplish a buffering action. Here, the buffering force of the elastic unit 70 increases in proportion to a falling distance of the mounting plate 55, thereby efficiently reducing a free falling impact of the mounting plate 55.

If the number of the print media 50 mounted on the mounting plate 55 is greater than 1,000 sheets, the mounting plate 55 is maintained to be coupled to the coupling unit 73 of the elastic unit 70 during supplying the print medium 50. Accordingly, although the mounting plate 55 is moved downward as the driving force supplied from the driving source 85 to the shaft 81 and the driving pulley 63 is intercepted in the coupler 83 as a result of that the print medium supplying device is separated from the image forming apparatus, the mounting plate 55 is buffered by the elastic unit 70 without falling free. Here, the buffering force of the elastic unit 70 increases in proportion to a falling distance of the mounting plate 55, thereby efficiently reducing the free falling impact of the mounting plate 55.

Figure 7:
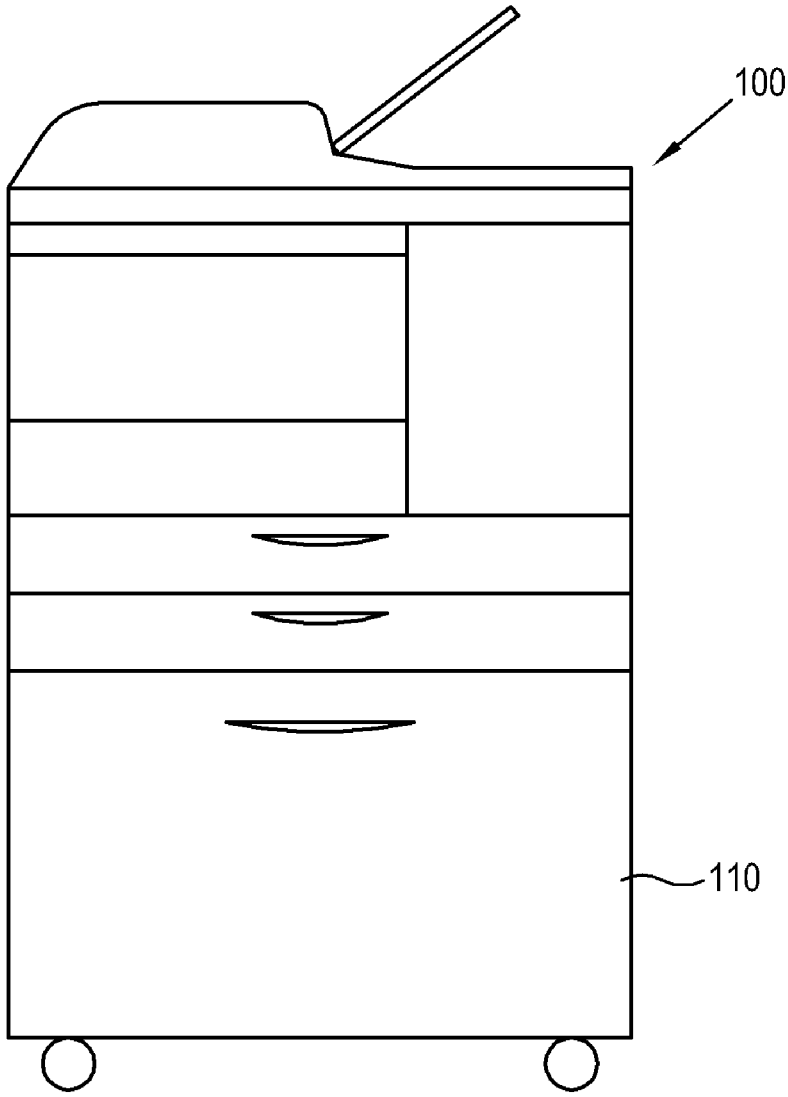
FIG. 7 schematically illustrates an image forming apparatus according to an exemplary embodiment of the present general inventive concept.

Referring to FIG. 7, an image forming apparatus according to an exemplary embodiment of the present general inventive concept includes a print medium supplying device 110 being capable of supplying a print medium in a big capacity, and an image forming unit 100 to form an image to the print medium supplied by the print medium supplying device 110. The image forming apparatus may have a pick-up unit 30 to pick-up and feed the print medium 50 toward the image forming unit 100. Here, the print medium supplying device 110 may have the same configuration as the print medium supplying device according to the exemplary embodiment of the present general inventive concept as illustrated in FIGS. 2 to 6.

As described above, the present general inventive concept provides a print medium supplying device and an image forming apparatus having the same being provided with an elastic unit instead of a conventional gear oil damper to reduce a falling speed of a mounting plate irrespective of a number of mounted print media, thereby preventing the print medium supplying device from being damaged, and reducing noises when the print medium supplying device in a mounting position is separated from the image forming apparatus.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a print medium supplying device comprising:

a frame;

a mounting plate to mount a print medium;

an elevating unit to move upward and downward the mounting plate within the frame; and an elastic unit comprising an installation unit disposed to one of the frame and the mounting plate, a coupling unit to selectively couple to an other of the frame and the mounting plate, and a spring unit provided between the installation unit and the coupling unit to elastically weaken a falling motion of the mounting plate; and an image forming unit to form an image with respect to the print medium supplied by the print medium supplying device.

2. The image forming apparatus of claim 1, wherein the elastic unit further comprises:

an elastic plate having a tape shape, and spirally winds around the installation unit.

3. The image forming apparatus of claim 2, wherein the coupling unit is disposed in an end portion of the spring unit to be engaged to the mounting plate, if the mounting plate falls below a predetermined height.

4. The image forming apparatus of claim 1, wherein:

the elastic unit is provided in plurality; and each elastic unit is provided at a plurality of positions along a perimeter of the mounting plate.

5. The image forming apparatus of claim 1, wherein the elevating unit comprises:

a driving pulley disposed in the frame to be rotated by an applied driving force;

a driven pulley disposed in the frame to be distanced from the driving pulley in a vertical direction of the frame; and a belt to rotatably wind around the driving pulley and the driven pulley, and is coupled with the mounting plate.

6. An image forming apparatus, comprising:

a print medium supplying device, comprising:

a frame;

a mounting plate disposed in the frame to move upward and downward, and to mount a print medium;

an elevating unit which is disposed in the frame to adjust a height of the mounting plate based on a number of the print media mounted on the mounting plate; and an elastic unit to elastically support the mounting plate to reduce a falling impact when the mounting plate which is lifted to a predetermined height falls down according to a release of a driving force to drive the elevating unit, wherein the elastic unit comprises an installation unit disposed in the frame, a coupling unit to selectively couple the mounting plate, and a spring unit provided between the installation unit and the coupling unit to elastically weaken a falling motion of the mounting plate; and an image forming unit to form an image with respect to the print medium supplied by the print medium supplying device.

7. The image forming apparatus of claim 6, wherein the elastic unit comprises:

an elastic plate having a tape shape, and spirally winds around the installation unit.

8. The image forming apparatus of claim 6, wherein the positions of the frame which respectively correspond to a minimum height and a maximum height of the mounting plate which is disposed to move upward and downward with respect to the frame are respectively referred to a first position and a second position, the installation unit is disposed between the first position and the second position, elastically supports the mounting plate when the mounting plate is positioned between the first position and the installation unit, and is separated from the mounting plate when the mounting plate is positioned between the installation unit and the second position.

9. The image forming apparatus of claim 6, wherein:

the elastic unit is provided in plurality; and each elastic unit is provided at a plurality of positions along a perimeter of the mounting plate.

10. The image forming apparatus of claim 6, wherein the elevating unit comprises:

a driving pulley disposed in the frame to be rotated by an applied driving force;

a driven pulley disposed in the frame to be distanced from the driving pulley in a vertical direction of the frame; and a belt to rotatably wind around the driving pulley and the driven pulley, and is coupled with the mounting plate.

11. A print medium supplying device usable with an image forming apparatus, the print medium supplying device comprising:

a frame;

a mounting plate disposed proximate to the frame to store and to supply a print medium; and one or more elastic units disposed between the frame and the mounting plate to elastically weaken a falling motion of the mounting plate, wherein the one or more elastic units comprise an installation unit disposed to one of the frame and the mounting plate, a coupling unit to selectively couple at least one of the frame and the mounting plate, when the mounting plate falls below a predetermined height, and a spring unit disposed between the installation unit and the coupling unit to elastically weaken the falling motion of the mounting plate.

12. The print medium supply device of claim 11, wherein a buffering force of at least one elastic unit increases in proportion to a falling distance of the mounting plate.

13. The print medium supply device of claim 11, wherein the one or more elastic units comprise:

a plurality of elastic units disposed at a plurality of positions along a perimeter of the mounting plate.

14. A print medium supplying device usable with an image forming apparatus, the print medium supply device comprising:

a frame;

a mounting plate disposed in the frame to move with respect to the frame to support a print medium; and an elastic unit disposed at a position within a moving distance of the mounting plate and comprising an installation unit disposed in the frame, a coupling unit to selectively couple to the mounting plate to apply a variable elastic force to the mounting plate, and a spring unit provided between the installation unit and the coupling unit to elastically weaken a falling motion of the mounting plate.

15. The print medium supplying device of claim 14, wherein the spring unit extends from the position to generate the variable elastic force according to a second distance of the mounting plate from the position.

* * * * *